US006256942B1

(12) United States Patent
Schatz

(10) Patent No.: US 6,256,942 B1
(45) Date of Patent: Jul. 10, 2001

(54) STAKE SYSTEM

(76) Inventor: Michael A. Schatz, 400 - 9th Street E., New England, ND (US) 58647

( * ) Notice: Subject to any disclaimer, the term of this patent is extended or adjusted under 35 U.S.C. 154(b) by 0 days.

(21) Appl. No.: 09/353,507

(22) Filed: Jul. 14, 1999

(51) Int. Cl.[7] ..... E02D 5/74

(52) U.S. Cl. ..... 52/155; 52/156; 52/166; 52/158; 135/118

(58) Field of Search ..... 52/155, 156, 166, 52/162, 163, 164, 158, 165; 135/118

(56) References Cited

U.S. PATENT DOCUMENTS

| | | | | |
|---|---|---|---|---|
| D. 208,013 | * | 6/1967 | Carr-Harris | 135/118 |
| 287,156 | * | 10/1883 | Peetz | 52/155 |
| 356,517 | * | 1/1887 | Wilson | 52/155 |
| 828,509 | * | 8/1906 | Rounsburg | 52/155 |
| 1,008,323 | * | 11/1911 | Gillespie | 52/155 |
| 1,153,450 | * | 9/1915 | Schaff | 52/155 |
| 1,854,671 | * | 4/1932 | Roberts | 52/155 |
| 2,858,917 | * | 11/1958 | Wendt | 52/155 |
| 3,324,666 | * | 6/1967 | Lee | 52/155 |
| 3,797,260 | * | 3/1974 | Webb | 52/161 |
| 3,974,604 | * | 8/1976 | Conn et al. | 52/160 |
| 3,986,366 | * | 10/1976 | Dinsmore, Jr. | 52/155 |
| 5,217,194 | * | 6/1993 | Brownell | 52/160 |
| 5,226,829 | * | 7/1993 | Jones | 52/166 |
| 5,291,703 | * | 3/1994 | Ziegler | 52/156 |
| 5,396,743 | * | 3/1995 | Bellette | 52/155 |
| 5,625,983 | * | 5/1997 | Lachance et al. | 52/155 |
| 5,975,808 | * | 11/1999 | Fujita | 52/155 |

* cited by examiner

*Primary Examiner*—Beth A. Stephan
*Assistant Examiner*—Dennis L. Dorsey

(57) ABSTRACT

A stake system for utilization within various types of soil conditions without require various designs of stakes. The inventive device includes a shaft having a spiked end, a hook secured to the upper end of the shaft, and a pair of first prongs secured to the lower portion of the shaft. The first prongs are comprised of a bendable material for allowing adjustment of the angle with respect to the shaft. If the invention is utilized within light soil, sand or gravel, the first prongs are preferably extended at a significant angle with respect to the shaft. If the invention is utilized within heavy soil, the first prongs are preferably parallel to or slightly extended from the shaft. In an alternative embodiment, a pair of second prongs are attached to the shaft in addition to the first prongs for increasing the gripping within the soil surface.

3 Claims, 3 Drawing Sheets

STAKE SYSTEM

BACKGROUND OF THE INVENTION

1. Field of the Invention

The present invention relates generally to stake devices and more specifically it relates to a stake system for utilization within various types of soil conditions without require various designs of stakes.

Tents and other structure often require the utilization of stake devices for retaining the structure in a desired position. There are various types of soil conditions that these stake devices are utilized within including clay, sand, gravel, heavy soil and light soil. Conventional stake devices are very suitable for the specific type of soil they are designed for.

However, conventional stake devices are not as useful for various types of soil conditions and often times pull out of the ground. Many individuals therefore carry various designs of stake devices to ensure they have the desired stake for the soil conditions at hand.

Unfortunately, carrying a plurality of stake designs consumes valuable storage pace and adds considerable weight to the material. Hence, there is a need for a stake system that is useful within various types of soil conditions and that can be adjusted accordingly to achieve the desirable ground engagement.

2. Description of the Prior Art

Stake devices have been in use for years. Typically, conventional stake devices comprised a shaft having a pointed lower end and a flanged upper end. The user drives the conventional stake device into the ground surface with a hammer or other structure. The user then ties a rope or cable about the upper end of the conventional stake device and then ties the opposing end to the structure to be retained.

Conventional stake devices work fine for normal soil conditions. However, when encountering sandy, gravel or light soil conditions, conventional stake devices often times are unintentionally removed from the ground surface by forces such as wind.

Examples of attempted stake devices include U.S. Pat. No. 828,509 to Rounsburg; U.S. Pat. No. 5,396,743 to Bellette; U.S. Pat. No. 5,217,194 to Brownell; U.S. Pat. No. 1,008,323 to Gillespie; U.S. Pat. No. 5,625,983 to Lachance et al.; U.S. Pat. No. 287,156 to Sloane which are all illustrative of such prior art.

Rounsburg (U.S. Pat. No. 828,509) discloses a tent stake. Rounsburg teaches a stock having transverse apertures near the lower end, a rod for movement longitudinally through the stock connectable to the guy members, and a pair of anchor members pivoted to the opposite end of the rod for protruding through the transverse apertures when the rod is moved upwardly. Rounsburg is a suitable product for light soil conditions, however Rounsburg is undesirable within heavy soil conditions because of the extreme difficulty in removing the device from the ground surface after insertion.

Bellette (U.S. Pat. No. 5,396,743) discloses an anchorage device for use I sand or sandy soils. Bellette teaches a shank member having a spiked end and a plurality of downwardly convergent plates for capturing the sand.

Brownell (U.S. Pat. No. 5,217,194) discloses a yard swing stabilizer apparatus. Brownell teaches a lower tube having a V-shaped anchor, and a plurality of anchor rods pivotally mounted to an inner tube for projection through slots of the outer tube for securing within the ground surface.

While these devices may be suitable for the particular purpose to which they address, they are not as suitable for utilization within various types of soil conditions without require various designs of stakes. Conventional stake devices are suitable for the soil conditions they are designed for, however they are not as suitable for utilization within various types of soil conditions.

In these respects, the stake system according to the present invention substantially departs from the conventional concepts and designs of the prior art, and in so doing provides an apparatus primarily developed for the purpose of utilization within various types of soil conditions without require various designs of stakes.

SUMMARY OF THE INVENTION

In view of the foregoing disadvantages inherent in the known types of stake devices now present in the prior art, the present invention provides a new stake system construction wherein the same can be utilized for utilization within various types of soil conditions without require various designs of stakes.

The general purpose of the present invention, which will be described subsequently in greater detail, is to provide a new stake system that has many of the advantages of the stake devices mentioned heretofore and many novel features that result in a new stake system which is not anticipated, rendered obvious, suggested, or even implied by any of the prior art stake devices, either alone or in any combination thereof.

To attain this, the present invention generally comprises a shaft having a spiked end, a hook secured to the upper end of the shaft, and a pair of first prongs secured to the lower portion of the shaft. The first prongs are comprised of a bendable material for allowing adjustment of the angle with respect to the shaft. If the invention is utilized within light soil, sand or gravel, the first prongs are preferably extended at a significant angle with respect to the shaft. If the invention is utilized within heavy soil, the first prongs are preferably parallel to or slightly extended from the shaft. In an alternative embodiment, a pair of second prongs are attached to the shaft in addition to the first prongs for increasing the gripping within the soil surface.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a stake system that will overcome the shortcomings of the prior art devices.

Another object is to provide a stake system that can be utilized within various types of soil conditions such as sand, gravel, heavy soil, light soil and asphalt.

An additional object is to provide a stake system that eliminates the need for having various types of stakes that are suitable for a corresponding variety of soil conditions.

A further object is to provide a stake system that save valuable storage space by eliminating the need to bring various designs of stakes.

Another object is to provide a stake system that is simple and durable for utilization over extended periods of time.

A further object is to provide a stake system that is not easily removed from the ground surface.

Another object is to provide a stake system that is simple and easy to adjust for most users.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
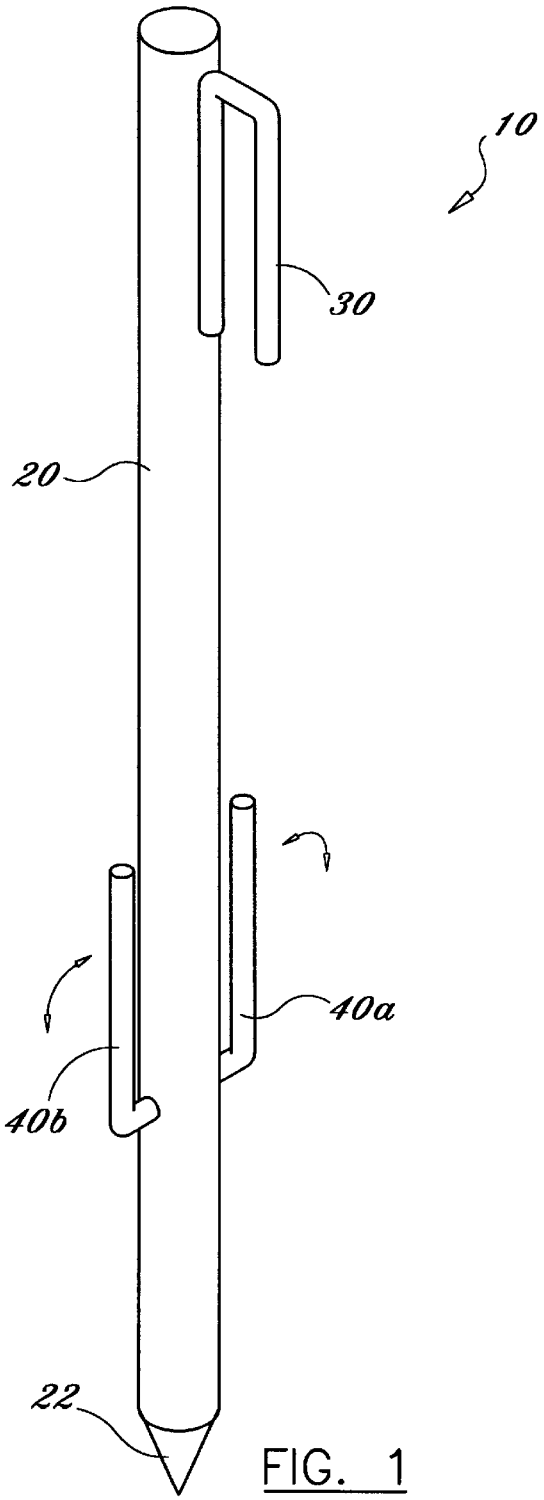
FIG. 1 is an upper perspective view of the present invention.

Turning now descriptively to the drawings, in which similar reference characters denote similar elements throughout the several view, FIGS. 1 through 5 illustrate a stake system 10, which comprises a shaft 20 having a spiked end 22, a hook 30 secured to the upper end of the shaft 20, and a pair of first prongs 40*a–b* secured to the lower portion of the shaft 20. The first prongs 40*a–b* are comprised of a bendable material for allowing adjustment of the angle with respect to the shaft 20. If the invention is utilized within light soil, sand or gravel, the first prongs 40*a–b* are preferably extended at a significant angle with respect to the shaft 20. If the invention is utilized within heavy soil, the first prongs 40*a–b* are preferably parallel to or slightly extended from the shaft 20. In an alternative embodiment, a pair of second prongs 50*a–b* are attached to the shaft 20 in addition to the first prongs 40*a–b* for increasing the gripping within the soil surface.

Figure 2:
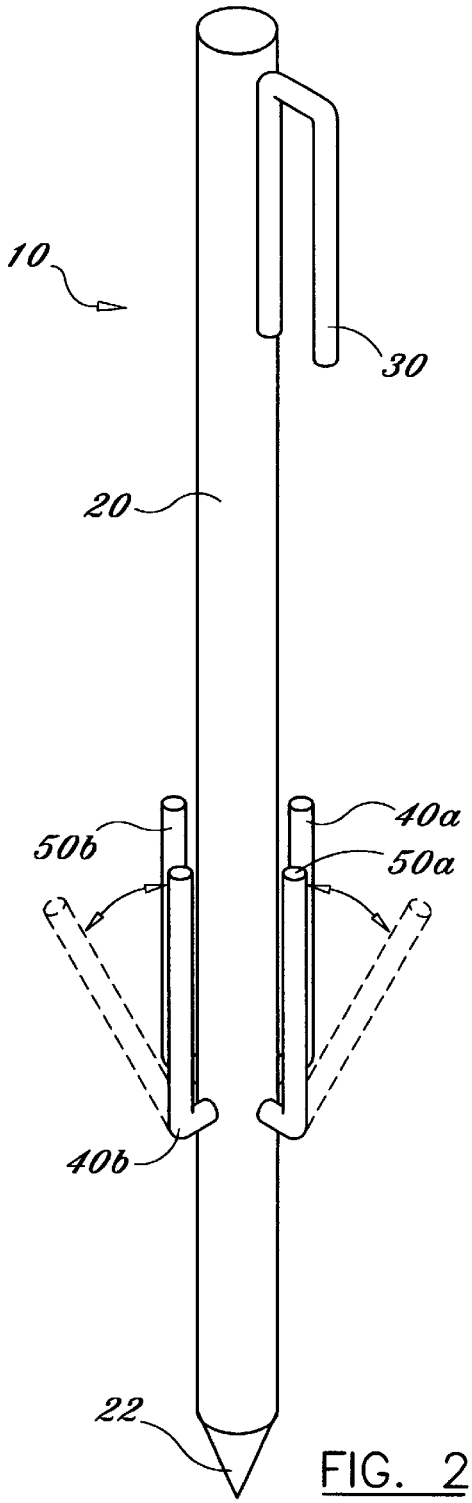
FIG. 2 is an upper perspective view of an alternative embodiment of the present invention having a second set of prongs.
Figure 3:
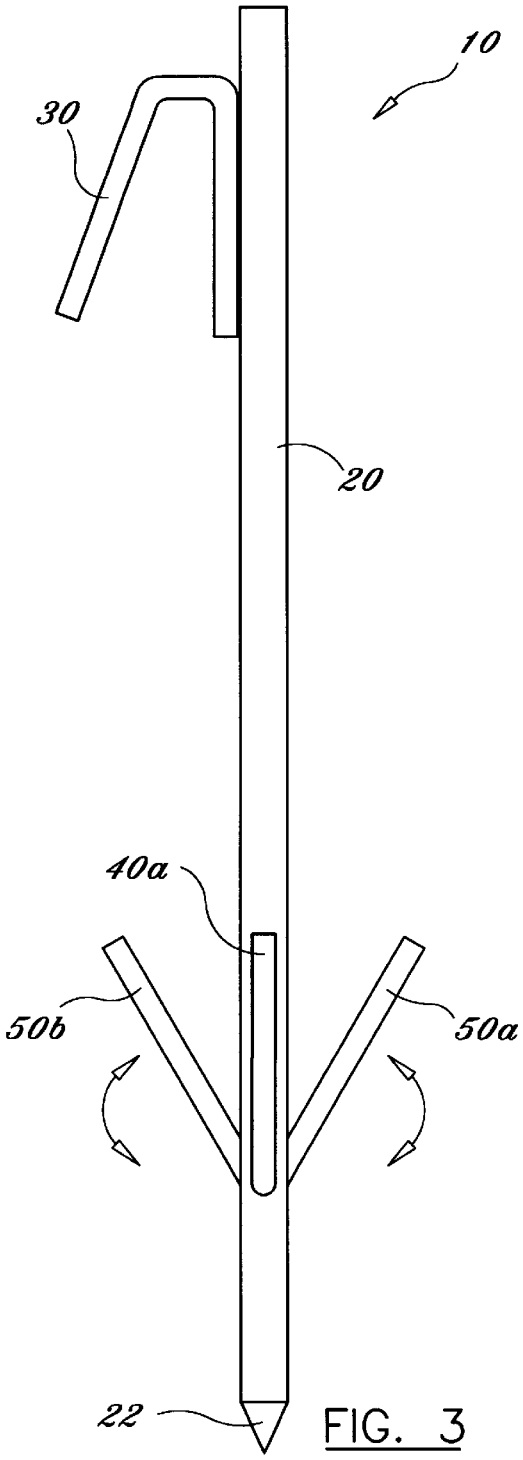
FIG. 3 is a side view of the alternative embodiment.
Figure 4:
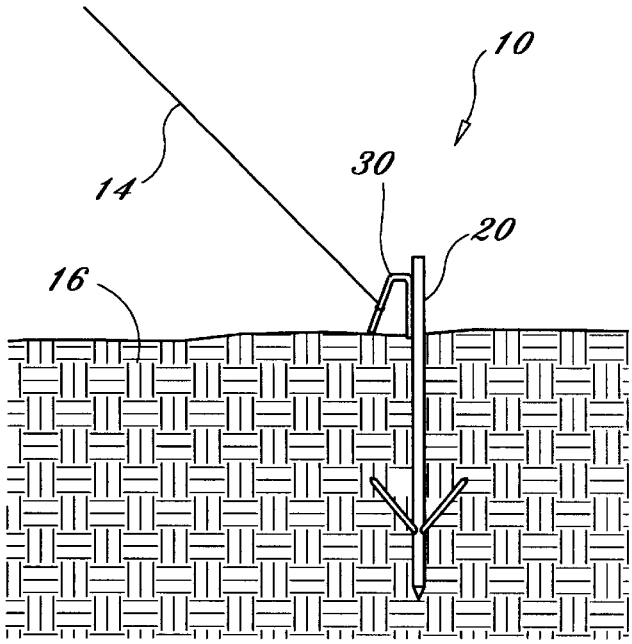
FIG. 4 is a side view of the present invention positioned within the ground and having the first prongs extended away from the shaft.
Figure 5:
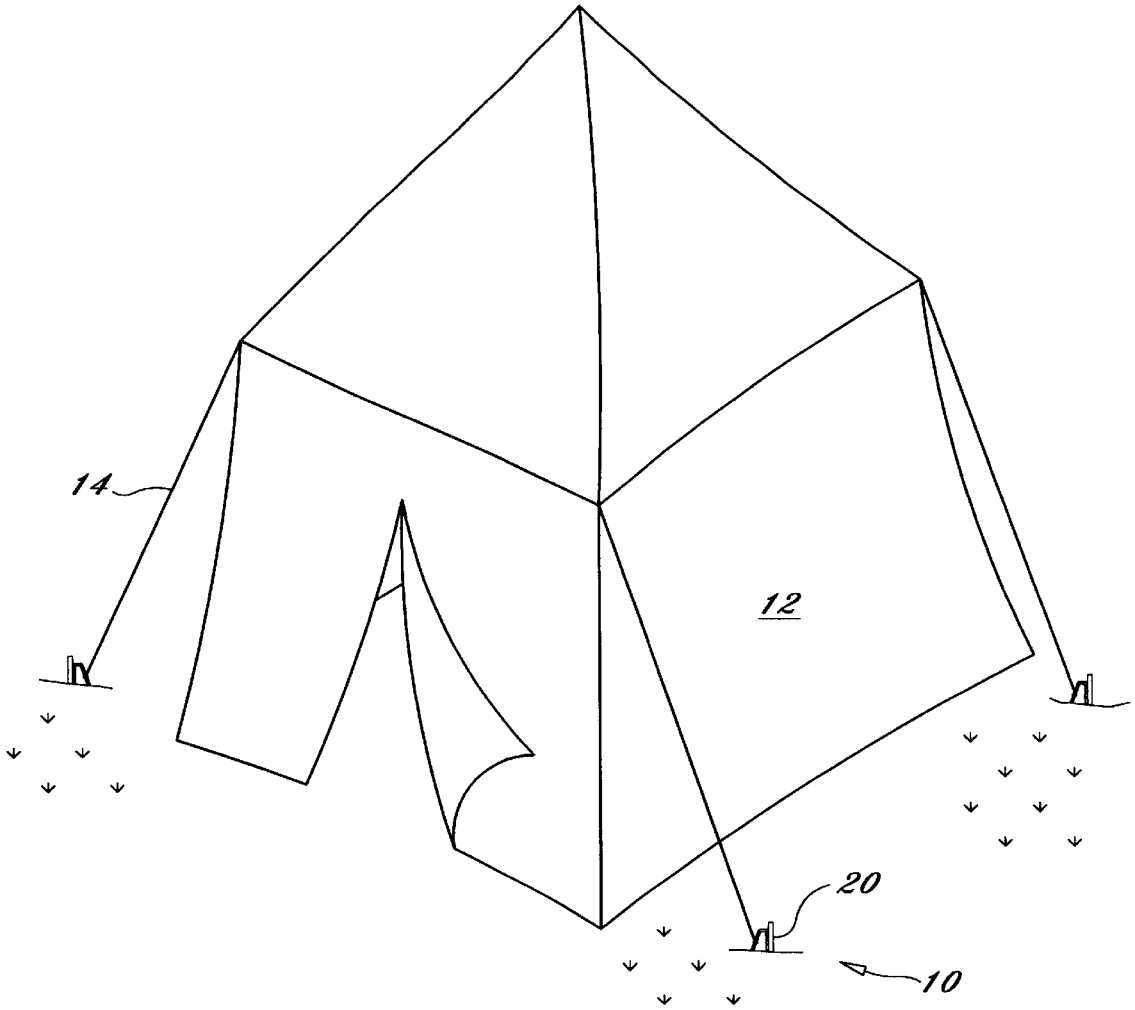
FIG. 5 is an upper perspective view of the present invention retaining a tent through attachment of the lines.

As shown in FIGS. 1 through 4 of the drawings, the shaft 20 is an elongate structure. The shaft 20 is preferably constructed of a rigid material such as steel. The shaft 20 has a lower end and an upper end as shown in FIG. 4 of the drawings. The shaft 20 preferably includes a spiked end 22 within the lower end as best shown in FIG. 3 of the drawings. The spiked end 22 is utilized for hard soil conditions or asphalt. It can be appreciated that the spiked end 22 is not required for softer soil conditions such as sand or gravel.

As best shown in FIGS. 1 through 4 of the drawings, a hook 30 is attached to the upper end of the shaft 20 for capturing a guy line 14 or other structure. As best shown in FIG. 3 of the drawings, the hook 30 preferably extends away from the shaft 20 and then is angled downwardly for a finite distance. This inverted U-shape allows the user to capture a rope or other structure between the ground 16 and the shaft 20.

As best shown in FIG. 1 of the drawings, a pair of first prongs 40*a–b* are attached to the lower portion of the shaft 20 opposite of the hook 30. The pair of first prongs 40*a–b* are preferably on opposing sides of the shaft 20 as further shown in FIG. 1 of the drawings. The pair of first prongs 40*a–b* are constructed of a bendable material that allows them to be at various angles with respect to the shaft 20 depending upon the soil conditions to be utilized within. The distal ends of the first prongs 40*a–b* may be spiked or blunt.

In an alternative embodiment of the present invention shown in FIGS. 2 and 3 of the drawings, a pair of second prongs 50*a–b* are attached to the lower portion of the shaft 20 opposite of the hook 30. The pair of second prongs 50*a–b* are preferably on opposing sides of the shaft 20 and adjacent the pair of first prongs 40*a–b* as further shown in FIG. 2 of the drawings. The pair of second prongs 50*a–b* are constructed of a bendable material that allows them to be at various angles with respect to the shaft 20 depending upon the soil conditions to be utilized within. The distal ends of the second prongs 50*a–b* may be spiked or blunt. It can be appreciated that any number of prongs 40, 50 may be utilized depending upon the type of soil conditions to be utilized within.

In use, the user determines the soil conditions and the amount of forces likely to be encountered with the particular structure, such as a tent 12, they are attempting to secure. The user then adjusts the angle of the prongs 40*a–b*, 50*a–b* accordingly. For example, if the invention is utilized within light soil, sand or gravel, the prongs 40*a–b*, 50*a–b* are preferably extended at a significant angle with respect to the shaft 20 such as 45 degrees for preventing accidental removal of the shaft 20 from the ground 16 surface. If the invention is utilized within heavy soil, the prongs 40*a–b*, 50*a–b* are preferably parallel to or slightly extended from the shaft 20 such as 10 degrees for allowing removal of the shaft 20 from the ground 16 surface. The user then engages the upper end of the shaft 20 with a hammer or other device thereby driving the shaft 20 into the ground 16. When the hook 30 is close to the surface of the ground 16, the user then positions the line 14 about the shaft 20 and the hook 30 then continues driving the shaft 20 into the ground 16 until the distal end of the hook 30 is in engagement with the surface of the ground 16. The plurality of prongs 40*a–b*, 50*a–b* prevents the shaft 20 from being accidentally removed from the surface of the ground 16 by winds or other forces.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stake system, comprising:

a shaft having an upper end and a lower end, wherein said lower end is spiked;

a first pair of prongs extending from opposing sides of said shaft near said lower end, wherein said first pair of prongs are constructed of a bendable material;

a second pair of prongs extending from opposing sides of said shaft near said lower end, wherein said second pair of prongs are constructed of a bendable material and are positioned 90 degrees with respect to said first pair of prongs;

wherein said first pair of prongs and said second pair of prongs each have a first portion that extends orthogonally from said shaft along a common radial axis, and a second portion extending substantially upwardly and orthogonally from said first portion wherein said second portion is longer than said first portion; and a hook member secured to said upper end of said shaft opposite of said lower end.

2. The stake system of claim 1, wherein said hook member has an inverted U-shape.

3. The stake system of claim 1, wherein said hook member is comprised of:

a horizontal portion extending from said upper end of said shaft; and an angled portion extending from the distal end of said horizontal portion a finite distance.

* * * * *